US005851243A

United States Patent [19]

Dickerson et al.

[11] Patent Number: 5,851,243

[45] **Date of Patent: *Dec. 22, 1998**

[54] RADIOGRAPHIC ELEMENTS CAPABLE OF RAPID ACCESS PROCESSING MODIFIED TO REDUCE RED LIGHT TRANSMISSION

[75] Inventors: Robert E. Dickerson, Hamlin; Rickey J. Seyler, Hilton, both of N.Y.

[73] Assignee: Eastman Kodak Company, Rochester, N.Y.

[ * ] Notice: The term of this patent shall not extend beyond the expiration date of Pat. No. 5,744,294.

[21] Appl. No.: 847,280

[22] Filed: Apr. 30, 1997

[51] Int. Cl.[6] ..... G03C 1/10; G03C 5/16

[52] U.S. Cl. ..... 430/517; 430/966; 430/559; 430/504; 430/963

[58] Field of Search ..... 430/517, 966, 430/559, 504, 963

[56] References Cited

U.S. PATENT DOCUMENTS

| | | | |
|---|---|---|---|
| 4,267,306 | 5/1981 | Davis et al. | 528/226 |
| 4,414,304 | 11/1983 | Dickerson | 430/353 |
| 4,803,150 | 2/1989 | Dickerson et al. | 430/502 |
| 4,804,716 | 2/1989 | Weaver et al. | 525/420 |
| 4,999,418 | 3/1991 | Krutak et al. | 528/272 |
| 5,196,299 | 3/1993 | Dickerson et al. | 430/567 |
| 5,213,951 | 5/1993 | Delfino | 430/504 |
| 5,292,627 | 3/1994 | Hershey et al. | 430/356 |
| 5,292,855 | 3/1994 | Krutak et al. | 528/289 |
| 5,372,864 | 12/1994 | Weaver et al. | 428/36.92 |
| 5,384,377 | 1/1995 | Weaver et al. | 525/437 |
| 5,468,599 | 11/1995 | Biavasco et al. | 430/512 |
| 5,576,156 | 11/1996 | Dickerson | 430/502 |
| 5,744,294 | 4/1998 | Dickerson et al. | 430/521 |

OTHER PUBLICATIONS

Research Disclosure, vol. 184, Aug. 1979, Item 18431, XII. Film Supports.

*Primary Examiner*—Mark F. Huff
*Attorney, Agent, or Firm*—Carl O. Thomas

[57] ABSTRACT

A radiographic element is disclosed capable of producing a maximum density of at least 3.0 when imagewise exposed and processed in less than 45 seconds. The element includes magenta dye or dyes, including a dye for spectrally sensitizing radiation-sensitive silver halide grains, that leave a residual density at 505 nm of greater than 0.1 when the element is processed. Transmission of red light through the radiographic element when imagewise exposed and processed to produce a viewable image is reduced by the incorporation in at least one of the hydrophilic colloid layers of at least one ionic linear condensation polymer containing a cyan phthalocyanine dye.

13 Claims, No Drawings

RADIOGRAPHIC ELEMENTS CAPABLE OF RAPID ACCESS PROCESSING MODIFIED TO REDUCE RED LIGHT TRANSMISSION

FIELD OF THE INVENTION

The invention relates to an element for recording an image pattern of X-radiation exposure. More specifically, the invention relates to radiographic elements containing at least one radiation-sensitive silver halide emulsion layer.

DEFINITION OF TERMS

The term "intensifying screen" is employed to indicate an element containing a phosphor capable of absorbing an image pattern of X-radiation and emitting a corresponding image pattern of visible light.

The term "radiographic element" designates an element capable of forming a visible image corresponding to an image pattern of X-radiation. Radiographic elements in their most common form produce a viewable image following light exposure by an intensifying screen or a pair of intensifying screens.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "warmer" in referring to image tone are used to mean CIELAB b* values measured at minimum density that are more negative or positive, respectively. The b* values describe the yellowness vs. blueness of an image with more positive values indicating a tendency toward greater yellowness. a* values compare greeness vs. redness with more positive values indicating a relatively higher proportion of red light. a* and b* measurement techniques are described by Billmeyer and Saltzman, *Principles of Color Technology*, 2nd. Ed., Wiley, New York, 1981, at Chapter 3. a* and b* measurements were developed by the Commission International de l'Esclairage (International Commission on Illumination).

In referring to grains and emulsions containing two or more halides, the halides are named in order of ascending concentrations.

The terms "high bromide" and "high chloride" in referring to grains and emulsions indicates that bromide or chloride, respectively, is present in concentrations of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "fully forehardened" indicates hydrophilic colloid layers that require no additional hardening after imagewise exposure. Typically fully forehardened hydrophilic colloid layers exhibit limited swelling when tested as described in Dickerson U.S. Pat. Nos. 4,414,304 and 5,576,156, here incorporated by reference.

The term "rapid access" in referring to the processing of radiographic elements indicates dry-to-dry processing in 90 seconds or less. That is, 90 seconds or less elapse between the time the dry, imagewise exposed element is introduced into a processor and the time the dry, processed element emerges from the processor.

The term "polyester ionomer" indicates a polyester that contains at least one ionic moiety.

The term "half peak absorption bandwidth" refers to the spectral range in nm over which a dye exhibits a level of absorption equal to at least half of its peak absorption ($\lambda_{max}$).

*Research Disclosure* is published by Kenneth Mason Publications, Ltd., Dudley House, 12 North St., Emsworth, Hampshire P010 7DQ, England.

BACKGROUND

Radiographic elements are commonly formed by coating hydrophilic colloid layers on one or both sides of a transparent film support At least one of the hydrophilic colloid layers contains a radiation-sensitive silver halide emulsion that forms a latent image when imagewise exposed to X-radiation and/or light.

Upon subsequent processing in a developer and then a fixing solution, followed by rinsing and drying, a viewable silver image is created in the radiographic element. Radiographic images are commonly "read" by placing a fully processed element on a light box, which transmits diffuse white light to and through the radiographic element for viewing. The viewer then sees the silver image in the film against a bright, backlit background.

In medical diagnostic imaging, which is by far the largest end use for radiographic elements, radiologists require a cold (i.e., blue-black) image tone. A cold image tone reduces eye strain and, by years of use, has become an aesthetic requirement for film acceptance and use by radiologists. The quantitative technique for verifying how "cold" or "warm" an image is by b* value determination.

While adding toning agents to the emulsion layers is a known expedient for producing colder image tones, as illustrated by Hershey U.S. Pat. No. 5,292,627, a more generally used technique is to incorporate a blue dye in the transparent film support. This provides an overall blue tint to the film as it is being viewed and causes the developed silver image to appear colder. Typically anthraquinone dyes are incorporated in the support as blue tinting dyes. Such dyes are illustrated by *Research Disclosure*, Vol. 184, August 1979, Item 18431, XII. Film Supports. The amount of blue dye that can be added to obtain a favorably cold image tone is limited by the highest tolerable level of minimum neutral density, which is less than 0.30, preferably less than 0.25. Generally the lowest attainable levels of minimum neutral density are sought that can be attained after exposure and processing, consistent with acceptable image tone.

Biavasco et al U.S. Pat. No. 5,468,599 discloses adding phthalocyanine blue pigment to a hydrophilic colloid layer of a photographic element containing a spectrally sensitized tabular grain emulsion to reduce minimum density and reduce dye stain.

The modification of polyesters and polyamides by the incorporation of a dye chromophore is disclosed by Davis et al U.S. Pat. No. 4,267,306, Weaver et al U.S. Pat. Nos. 4,804,719, 5,372,864 and 5,384,377, and Krutak et al U.S. Pat. Nos. 4,999,418 and 5,292,855.

RELATED APPLICATION

Dickerson et al U.S. application Ser. No. 08/846,696, filed Apr. 30, 1997, now allowed, commonly assigned, titled RADIOGRAPHIC ELEMENTS MODIFIED TO PROVIDE PROTECTION FROM VISUAL FATIGUE, discloses a radiographic element having a transparent film support and a blue anthraquinone dye. Transmission of red light through the exposed and processed radiographic element is reduced by coating on the support at least one ionic linear condensation polymer containing a cyan phthalocyanine dye.

PROBLEM TO BE SOLVED

Radiographic elements intended to be exposed by green emitting intensifying screens contain one or more magenta dyes that selectively absorb light in the green region of the spectrum. In all instances these elements contain a spectral sensitizing dye for the radiation-sensitive silver halide grains. When grains having high surface area to volume are employed, such as smaller grains and tabular grains, the amount of spectral sensitizing dye can in itself present a residual dye stain problem. Additionally, in elements having radiation-sensitive grains on only one side of the support, a magenta (green absorbing) antihalation dye is usually present in the element. When radiation-sensitive grains are coated on both sides of the support, it is common practice to coat a magenta (green absorbing) dye in the layer nearest the support on both sides of the support. Magenta dyes and dye combinations that are capable of serving these functions have been developed that are decolorized or removed during processing.

However, recently overall rapid access processing times have been reduced to less than 45 seconds. This has resulted in green densities of greater than 0.1 in the radiographic elements which has in turn limited the amount of blue dye that can be incorporated for the purpose of creating a cold image tone while maintaining acceptable levels of minimum neutral density after imagewise exposure and processing.

SUMMARY OF THE INVENTION

It has been discovered that lowering blue dye incorporation to accommodate overall minimum density requirements when employing less than 45 second processing has left appreciable green density attributable to retained magenta dye and has created a problem of visual fatigue. Larger amounts of red light are now being transmitted through the fully processed radiographic elements on viewing.

This problem was not immediately apparent, since generally b* values are relied upon for determining acceptable image tones for end use. However, it is possible to achieve aim b* values, indicative of a cold image tone, while still transmitting undesirably high levels of red light.

The present invention provides a radiographic element construction that allows suitably cold image tones and low levels of red light transmission to be realized while (a) maintaining neutral minimum densities within art accepted levels, (b) employing conventional magenta dyes, and (c) conducting rapid access processing in less than 45 seconds.

In one aspect the invention is directed to a radiographic element capable of producing a maximum density of at least 3.0 when imagewise exposed by X-radiation stimulated intensifying screen emission of green light and processed in less than 45 seconds. The element is comprised of (1) a transparent film support having first and second major faces, (2) a fully forehardened hydrophilic colloid layer unit coated on each major face of the support, at least one of the layer units including radiation-sensitive silver halide grains, (3) one or a combination of magenta dyes, including a dye for spectrally sensitizing the radiation-sensitive silver halide grains to green light, said dyes leaving a residual density at 505 nm of greater than 0.1 when the element is processed in less than 45 seconds, and (4) a blue dye that increases neutral density in minimum density areas after imagewise exposure and processing, wherein, transmission of red light through the radiographic element when imagewise exposed and processed in less than 45 seconds to produce a viewable image is reduced by the incorporation in at least one of the hydrophilic colloid layers of at least one ionic linear condensation polymer containing a cyan phthalocyanine dye.

PREFERRED EMBODIMENTS

The invention is an improvement on conventional radiographic elements that are capable of producing a maximum density of at least 3.0 when (1) imagewise exposed to green light, typically emitted by one or a pair of intensifying screens and (2) when processed in less than 45 seconds, exhibit a density of greater than 0.1 at a wavelength of 505 nm, indicative of retention of one or more magenta (green absorbing) dyes after processing.

The following represents a support and layer arrangement compatible with elements satisfying the requirements of the invention:

| (I) |
|---|
| Front Hydrophilic Colloid Layer Unit |
| Transparent Film Support |
| Back Hydrophilic Colloid Layer Unit |

While the transparent film support in its simplest form can consist of any flexible transparent film, it is common practice to modify the surfaces of photographic and radiographic film supports by providing subbing layers to promote the adhesion of hydrophilic colloids to the support. Although any conventional photographic film support can be employed, it is preferred to employ a radiographic film support, since this maximizes compatibility with the rapid access radiographic film processors in which the films of the invention are intended to be processed and provides a radiographic film look and feel to the processed film. Radiographic film supports usually exhibit these specific features: (1) the film support is constructed of polyesters to maximize dimensional integrity rather than employing cellulose acetate supports as are most commonly employed in photographic elements and (2) the film supports are typically blue tinted to contribute the cold (blue-black) image tone sought in the fully processed films, whereas photographic films rarely, if ever, employ blue tinted supports. Radiographic film supports, including the incorporated blue dyes that contribute to cold image tones, are described in *Research Disclosure*, Vol. 184, August 1979, Item 18431, Section XII. Film Supports. *Research Disclosure*, Vol. 389, September 1994, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthalate) are specifically preferred polyester film supports.

It is conceptually possible to construct the front hydrophilic colloid layer unit of a single hydrophilic colloid layer having dispersed therein radiation-sensitive silver halide grains—i.e., a single radiation-sensitive silver halide emulsion layer. In practice, the front hydrophilic colloid layer unit more typically exhibits the following structure:

| (FHCLU-I) |
|---|
| Surface Overcoat |
| Interlayer |
| Radiation-sensitive Emulsion Layer(s) |

Similarly, the back hydrophilic colloid layer unit can consist of a single hydrophilic colloid layer, but, preferably, the back hydrophilic colloid layer unit is also formed of a plurality of hydrophilic colloid layers.

When all of the radiation-sensitive emulsion or emulsions are confined to the front hydrophilic colloid layer unit, the following represents a typical preferred back hydrophilic colloid layer unit:

| (BHCLU-I) |
|---|
| Pelloid |
| Interlayer |
| Surface Overcoat |

Thus, a preferred element satisfying the requirements of the invention exhibits the following structure:

| (II) |
|---|
| Surface Overcoat |
| Interlayer |
| Radiation-sensitive Emulsion Layer(s) |
| Transparent Film Support |
| Pelloid |
| Interlayer |
| Surface Overcoat |

When the element is intended to be imagewise exposed concurrently from both sides, as occurs when a dual-coated radiographic element is mounted between a pair of light-emitting intensifying screens, in the simplest possible construction, both the front and back colloid layer units can take the form of a single radiation-sensitive silver halide emulsion layer.

In practice it is usually preferred to construct the element as follows:

| (III) |
|---|
| Surface Overcoat |
| Interlayer |
| Radiation-sensitive Emulsion Layer(s) |
| Crossover Control Layer |
| Transparent Film Support |
| Crossover Control Layer |
| Radiation-sensitive Emulsion Layer(s) |
| Interlayer |
| Surface Overcoat |

The surface overcoats and, particularly, the interlayers can be omitted from all of the constructions above. The pelloid and crossover control layers can be omitted with a loss in image sharpness. When at least two radiation-sensitive emulsion layers are present on one side of a dual-coated radiographic element, loss of image sharpness can be minimized by incorporating the crossover control function within the emulsion layer coated nearest the support To facilitate rapid access processing in less than 45 seconds, the hydrophilic colloid layer unit on each side of the support contains less an 35 mg/dm$^2$ of hydrophilic colloid, typically from 19 to 33 mg/dm$^2$. The hydrophilic colloid, except as modified by linear ionic condensation polymer inclusion, described below, can take any conventional form. The hydrophilic colloid layer units typically include as a vehicle gelatin or a gelatin derivative. Conventional vehicles and modifying components contemplated for use in the hydrophilic colloid layer units of the radiographic elements of the invention are disclosed in *Research Disclosure*, Item 38957, cited above, Section II. Vehicles, vehicle extenders, vehicle-like addenda and vehicle related addenda.

To reduce water intake during processing and thereby permit processing (including drying) within 45 seconds, the hydrophilic colloid layer units are fully forehardened. Fully forehardened radiographic elements have the same degree of hardening as conventional photographic elements, which are routinely fully forehardened. Forehardeners are disclosed in *Research Disclosure*, Item 38957, II., cited above, B. Hardeners. Generally any efficient forehardener can be used to achieve full forehardening. Although conventional hardeners can be used interchangeably with little or no impact on performance, particularly preferred forehardeners are the bis(vinylsulfonyl) class of hardeners, such as bis (vinylsulfonyl)alkyether and bis(vinylsulfonyl)alkane hardeners, where the alkyl moiety contains from 1 to 4 carbon atoms.

The radiation-sensitive emulsion layers each contain radiation-sensitive silver halide grains and, adsorbed to the grains, at least one spectral sensitizing dye that imparts radiation-sensitivity to the green region of the spectrum. That is, the spectral sensitizing dye is a magenta (green-absorbing) dye. Conventional spectral sensitizing dyes are illustrated by *Research Disclosure*, Item 38957, cited above, Section V., sub-section A. Sensitizing dyes. Most commonly these dyes are carbocyanine dyes and dimethine merocyanine dyes.

Although radiation-sensitive silver halide emulsions are generally useful in the radiographic elements of the invention and can take varied conventional forms, as illustrated *Research Disclosure*, Item 38957, cited above, I. Emulsion grains and their preparation, to achieve rapid access processing in less than 45 seconds the iodide content of the grains is limited to less than 3 (preferably less than 1) mole percent, based on silver. It is generally preferred to employ high bromide grains, particularly silver bromide and silver iodobromide grains, since these grains have generally shown higher imaging speeds. However, high chloride grains are capable of more rapid processing than high bromide grains. For an optimum combination of processing speeds and covering power (maximum density divided by silver coating coverages), it is preferred to employ silver bromochloride emulsions, optionally including iodide, as noted above, with bromide concentrations in the range of from 10 to 40 (preferably 20 to 30) mole percent, based on silver.

The present invention is particularly applicable to emulsions having smaller grain sizes, such as those with mean ECD's of less than 0.7 $\mu$m, and tabular grain emulsions. Both of these classes of emulsions contain high ratios of spectral sensitizing dye to silver when optimally spectrally sensitized and hence are more susceptible to residual dye stain attributable to failure to remove all of the spectral sensitizing dye from the element during processing in less than 45 seconds. Tabular grain emulsions having mean grain thicknesses of less than 0.3 μm are contemplated, with mean grain thicknesses of less than 0.2 μm being preferred. Generally the thinner the tabular grains, the higher is their surface area to volume ratio and hence the higher the amount of spectral sensitizing dye required for optimum spectral sensitization.

The radiation-sensitive silver halide grains are, of course chemically sensitized. Any conventional convenient chemical sensitization can be employed. Illustrations of chemical sensitization are provided by *Research Disclosure*, Item 38957, cited above, Section III. Chemical sensitization. The emulsion layers additionally include conventional antifoggants and stabilizers, such as those illustrated by *Research Disclosure*, Item 38957, cited above, Section VII, Antifoggants and Stabilizers.

To insure that the radiographic elements produce sharp images, it is conventional practice to include an antihalation dye in the Pelloid layer of element (II) or a crossover control dye in the Crossover Control Layers of element (III). When the radiation-sensitive emulsions are spectrally sensitized to the green region of the spectrum, these dyes are green absorbing magenta dyes. The conventional practice is to remove or decolorize antihalation and crossover control dyes during processing; however, this may not be fully accomplished when total processing times are reduced to less than 45 seconds, thereby resulting in elevated green (e.g., 505 nm) densities.

Since crossover control dyes must be coated on the same side of the support as a least one radiation-sensitive emulsion layer, it is preferred to employ particulate crossover control dyes. Dickerson et al U.S. Pat. Nos. 4,803,150 and 4,900,652, here incorporated by reference, disclose particulate dyes capable of (a) absorbing radiation to which the silver halide grains are responsive to reduce crossover to less than 15 percent and (b) being substantially decolorized during processing in less than 90 seconds. The particulate dyes can, in fact, substantially eliminate crossover. The mean ECD of the dye particles can range up to 10 μm, but is preferably less than 1 μm. Dye particle sizes down to about 0.01 μm can be conveniently formed. Where the dyes are initially crystallized in larger than desired particle sizes, conventional techniques for achieving smaller particle sizes can be employed, such as ball milling, roller milling, sand milling, and the like.

Since the hydrophilic colloid layers are typically coated as aqueous solutions in the pH range of from 5 to 6, most typically from 5.5 to 6.0, the dyes are selected to remain in particulate form at those pH levels in aqueous solutions. The dyes must, however, be readily soluble at the alkaline pH levels employed in photographic development. Dyes satisfying these requirements are nonionic in the pH range of coating, but ionic under the alkaline pH levels of processing. Preferred dyes are nonionic polymethine dyes, which include the merocyanine, oxonol, hemioxonol, styryl and arylidene dyes. In preferred forms the dyes contain carboxylic acid substituents, since these substituents are nonionic in the pH ranges of coating, but are ionic under alkaline processing conditions.

Specific examples of particulate dyes are described by Lemahieu et al U.S. Pat. No. 4,092,168, Diehl et al WO 88/04795 and EPO 0 274 723, and Factor et al EPO 0 299 435, Factor et al U.S. Pat. No. 4,900,653, Diehl et al U.S. Pat. No. 4,940,654 (dyes with groups having ionizable protons other than carboxy), Factor et al U.S. Pat. No. 4,948,718 (with arylpyrazolone nucleus), Diehl et al U.S. Pat. No. 4,950,586, Anderson et al U.S. Pat. No. 4,988,611 (particles of particular size ranges and substituent pKa values), Diehl et al U.S. Pat. No. 4,994,356, Usagawa et al U.S. Pat. No. 5,208,137, Adachi U.S. Pat. No. 5,213,957 (merocyanines), Usami U.S. Pat. No. 5,238,798 (pyrazolone oxonols), Usami et al U.S. Pat. No. 5,238,799 (pyrazolone oxonols), Diehl et al U.S. Pat. No. 5,213,956 (tricyanopropenes and others), Inagaki et al U.S. Pat. No. 5,075,205, Otp et al U.S. Pat. No. 5,098,818, Texter U.S. Pat. No. 5,274,109, McManus et al U.S. Pat. No. 5,098,820, Inagaki et al EPO 0 385 461, Fujita et al EPO 0 423 693, Usui EPO 0 423 742 (containing groups with specific pKa values), Usagawa et al EPO 0 434 413 (pyrazolones with particular sulfamoyl, carboxyl and similar substituents), Jimbo et al EPO 0 460 550, Diehl et al EPO 0 524 593 (having alkoxy or cyclic ether substituted phenyl substituents), Diehl et al EPO 0 524 594 (furan substituents) and Ohno EPO 0 552 646 (oxonols).

Generally any dye known to be useful as a crossover control dye is also useful as an antihalation dye. Since the antihalation dye can be coated on the side of the support opposite the location of the radiation-sensitive silver halide grains, the risk of dye desensitization is reduced. This allows the use of a broader range of dyes than are useful for crossover control. For example, whereas crossover control dyes are commonly coated in particulate form, an antihalation dye on the opposite side of a support from the radiation-sensitive grains need not be particulate form. Illustrations of conventional antihalation dyes are provided by *Research Disclosure*, Item 38957, Section VIII., sub-section B. Absorbing materials.

The surface overcoats are typically provided for physical protection of the emulsion and pelloid layers. In addition to vehicle features discussed above the overcoats can contain various addenda to modify the physical properties of the overcoats. Such addenda are illustrated by *Research Disclosure*, Item 38957, IX. Coating physical property modifying addenda, A. Coating aids, B. Plasticizers and lubricants, C. Antistats, and D. Matting agents. The interlayers are typically thin hydrophilic colloid layers that provide a separation between the emulsion or pelloid (particularly the former) and the surface overcoat addenda.

Except for the inclusion of an ionic linear condensation polymer, as discussed below, each of the layers of the hydrophilic colloid layer units can be selected from among convenient conventional form, as illustrated by the following, here incorporated by reference:

| Radiographic Elements Listing: | |
|---|---|
| Dickerson | U.S. Patent 4,414,304; |
| Abbott et al | U.S. Patent 4,425,425; |
| Abbott et al | U.S. Patent 4,425,426; |
| Dickerson | U.S. Patent 4,520,098; |
| Daubendiek et al | U.S. Patent 4,639,411; |
| Dickerson et al | U.S. Patent 4,803,150; |
| Abbott et al | U.S. Patent 4,865,958; |
| Dickerson et al | U.S. Patent 4,900,652; |
| Dickerson et al | U.S. Patent 4,994,355; |
| Dickerson et al | U.S. Patent 4,997,750; |
| Bunch et al | U.S. Patent 5,021,327; |
| Dickerson et al | U.S. Patent 5,041,364; |
| Dickerson et al | U.S. Patent 5,108,881; |
| Dickerson et al | U.S. Patent 5,196,299; |

-continued

| Radiographic Elements Listing: | |
|---|---|
| Pruett et al | U.S. Patent 5,215,876; |
| Dickerson et al | U.S. Patent 5,252,442; |
| Dickerson | U.S. Patent 5,252,443; |
| Hershey et al | U.S. Patent 5,292,627; |
| Hershey et al | U.S. Patent 5,292,631; |
| Hershey et al | U.S. Patent 5,314,790; |
| Zietlow | U.S. Patent 5,370,977; |
| Dickerson | U.S. Patent 5,391,469; |
| Dickerson et al | U.S. Patent 5,399,470; |
| Jones et al | U.S. Patent 5,491,058; |
| Fenton et al | U.S. Patent 5,567,580; and |
| Dickerson | U.S. Patent 5,576,156. |

The radiographic elements of Dickerson U.S. Pat. No. 5,576,156, incorporated by reference, are all fully applicable to the practice of the invention, since these structures are specifically contemplated for rapid access processing in less than 45 seconds. These structures place radiation-sensitive silver halide grains in the crossover control layers to reduce hydrophilic colloid coating coverages and thereby reduce processing times.

An ionic linear condensation polymer containing a cyan phthalocyanine dye chromophore incorporated as a repeating unit can be located in any hydrophilic colloid layer of the radiographic element. A preferred location for this polymer is in a pelloid layer or in a crossover control layer.

The ionic linear condensation polymers containing a cyan phthalocyanine dye chromophore incorporated in one or more of the hydrophilic colloid layers of the radiographic elements can be formed by modifying the structure of a conventional linear condensation polymer. Linear condensation polymers are conventionally formed by reacting a Type I monomer having two reactive moieties of a first type (typically basic moieties) with a Type II monomer having two reactive moieties of a second type (typically acidic moieties), where the first and second type moieties are chosen to enter into a condensation reaction with each other. This can be illustrated as follows:

$$R^1\text{-}T^1\text{-}R^1 + R^2\text{-}T^2\text{-}R^2 = T^3\text{-}(T^1\text{-}L\text{-}T^2\text{-}L)_m\text{-}T^4 \quad \text{(IV)}$$

where $R^1$-$T^1$-$R^1$ is a Type I monomer, $R^2$-$T^2$-$R^2$ is a Type II monomer, L is a linking group that results when $R^1$ and $R^2$ enter into a condensation reaction, m is an integer chosen to provide a desired molecular weight, and $T^3$ and $T^4$ are chain terminating groups.

When the $R^1$ reactive groups are hydroxy groups, $T^1$ preferably takes the form an alkyl group of from 1 to 6 carbon atoms. Thus, in a simple preferred form $R^1$-$T^1$-$R^1$ is a glycol, most preferably ethylene glycol. In a common variant form $T^1$ can contain from 2 to 12 carbon atoms and contain an internal oxy (—O—) ether linkage between carbon atoms. Alternatively, in forming polyamides, $R^1$ can take the form of a primary (—$NH_2$) or secondary amino (—$NHR^3$) group. $R^3$ is preferably alkyl of from 1 to 6 carbon atoms.

The $R^2$ reactive groups can be chosen from among carboxy groups [—C(O)OH]; carbonyl halide groups [—C(O)X, where X is a halide, typically chloride or bromide]; or ester groups [—OC(O)$R^4$, —OC(O)O$R^4$, OC(O)NH$R^4$, or —C(O)O$R^4$, where $R^4$ is alkyl, cycloalkyl or aryl, containing up to 10 carbon atoms]. Preferred ester groups are —C(O)O$R^4$ groups. Preferred $R^4$ alkyl groups contain from 1 to 6 carbon atoms. Preferred $R^4$ cycloalkyl groups are those containing from 3 to 8 ring carbon atoms, most preferably cyclopentyl and cyclohexyl groups. Preferred aryl groups are phenyl and naphthyl groups.

$T^2$ preferably takes the form of a phenylene or naphthylene group. Most commonly $R^2$-$T^2$-$R^2$ is phthalic, terephthalic or isophthalic acid or an esterified derivative. Dearomatized (hydro) variants of phthalic and terephthalic acids are also conventionally employed in forming polyesters.

To allow the linear condensation polymer to be dispersed in a hydrophilic colloid vehicle present in the radiographic element it is necessary to modify at least a portion of the Type I or Type II repeating units making up the polymer so that they contain an ionic moiety. One approach for achieving this result is to substitute for a portion of the $R^2$-$T^2$-$R^2$ monomer a corresponding monomer containing an ionic substituent. When the linear condensation polymer is a polyester, a preferred form, addition of the ionic substituents converts the polyester to a polyester ionomer, a polyester formed by the condensation of ionic monomeric units. In a specifically preferred form of the invention the ionic linear condensation polymers employed in the radiographic elements of the invention are polyester ionomers.

A preferred ionic substituent is a sulfo group(—$SO_3^-M^+$). M can be any convenient counterion, such as hydrogen ($H^+$), alkali metal (e.g., $Li^+$, $Na^+$or $K^+$) or alkaline earth metal (e.g., $Mg^{++}$ or $Ca^{++}$). Specifically preferred sulfo-substituted repeating units are sulfo-substituted phthalic, terephthalic or isophthalic acid (and phthalic acid derivative) repeating units, particularly sulfo-substituted isophthalic acid or a derivative, such as one of the derivative forms discussed above—e.g. a carbonylhalide or ester form noted above. The sulfo group need not be a direct substituent of the diacid benzene ring, but can be attached through an intermediate linking group, taking a form such as sulfoalkyl, sulfoalkyloxy, sulfoaryl or sulfoaryloxy, where the alkyl moieties contain from 1 to 6 carbon atoms and the aryl moieties are preferably phenyl moieties.

As an alternative to a sulfo substituent, it is contemplated to employ a substituent containing a sulfoimino [—$SO_2$—$N^-(M^+)$—] moiety. The substituent can, for example, satisfy the formula:

$$-SO_2-N^-(M^+)-(SO_2)_n-Y \quad \text{(V)}$$

wherein

M is as defined above, n is zero or 1, and

Y is alkyl of from 1 to 6 carbon atoms or aryl of from 6 to 12 carbon atoms, preferably phenyl.

It is also possible to incorporate disulfoimino moiety into the linear condensation polymer backbone by constructing the $R^2$-$T^2$-$R^2$ monomer described above to satisfy the formula:

$$R^3-C(O)Ar^1-SO_2-N^-(M^+)-SO_2-Ar^2C(O)-R^3 \quad \text{(VI)}$$

wherein $R^3$ represents the atoms completing a carboxylic acid, carbonylhalide or ester moiety, as described above; and $Ar^1$ and $Ar^2$ are arylene moieties containing from 6 to 10 carbon atoms, preferably m or p-phenylene moieties.

Illustrations of linear condensation polymers generally and polyester ionomers in particular containing repeating pendant or backbone ionic moieties of the type described above are provided by Noonan et al U.S. Pat. Nos. 4,097, 282, 4,252,921, 4,291,153, and 4,419,437 and Weaver et al et al U.S. Pat. No. 4,804,719, the disclosures of which are here incorporated by reference.

The incorporation of the ionic repeating units is adjusted as required to render the linear condensation polymer hydrophilic. Taking the sum of the terminal, basic (Type I), and acidic (Type II) groups forming the linear condensation polymer as 100 mole percent, the ionic repeating units can impart hydrophilic characteristics in concentrations of 1 mole percent or less. It is generally preferred that the ionic repeating units account for at least 5 mole percent of the polymer. By rendering the linear condensation polymer hydrophilic it can be acceptably mechanically blended with the hydrophilic colloid vehicle. As the proportion of the ionic repeating units in condensation polymer is increased the ease of obtaining a uniform distribution within the hydrophilic colloid vehicle is increased. No advantage has been identified for increasing the proportion of ionic repeating units beyond 40 mole percent of the condensation polymer. Generally convenient physical handling properties are observed in the ionic linear condensation polymer when overall molecular weights are maintained in the range of from about 10,000 to 100,000.

The ionic linear condensation polymer additionally contains repeating units containing a cyan phthalocyanine dye to absorb red light that would otherwise be transmitted through the radiographic element. The cyan dye is chosen to have a half-peak absorption bandwidth having its shortest wavelength equal to or greater than 600 nm. By confining the minimum wavelength of the half-peak bandwidth to 600 nm or longer, the principal absorption by the phthalocyanine dye lies outside the principal spectral regions of intensifying screen exposure, which are typically in the blue and green portions of the spectrum and, preferably, the latter. The half-peak absorption bandwidth of the phthalocyanine dye preferably extends over at least 50 nm of the 100 nm spectral region of from 600 to 700 nm. There is no disadvantage to having the half-peak absorption bandwidth of the phthalocyanine dye extend into the near infrared region of the spectrum.

When the radiographic element is a duplicating film intended to be exposed by photodiodides or a laser, such as a helium-neon laser, emitting in the red region of the spectrum, the cyan phthalocyanine dye half-peak absorption can overlap the spectral region of imagewise exposure. However, since the optical density of the phthalocyanine dye in the spectral region of its half-peak absorption bandwidth is typically limited to less than 0.2 and preferably less than 0.1, only a small adjustment of the controlled exposure light source is required to offset competing absorption by the phthalocyanine dye. Notice that this differs from medical diagnostic imaging employing intensifying screens. In the latter instance competing absorption by the phthalocyanine dye translates into higher patient exposures to X-radiation and is therefore avoided in dye selection.

The phthalocyanine dye is preferably incorporated in the ionic linear condensation polymer from a monomer satisfying the formula:

E-Pc-E (VII)

where

Pc is an optionally substituted phthalocyanine dye chromophore and

E is a reactive group $R^1$ or $R^2$, described above, which is preferably linked to the phthalocyanine dye chromophore through a linking group.

A particularly preferred linking group is a sulfamoyl group satisfying the formula:

$$-SO_2N(R^6)-R^7-R^8 \quad \text{(VIII)}$$

wherein $R^6$ is hydrogen or alkyl containing from 1 to 6 carbon atoms;

$R^7$ is alkylene containing from 1 to 6 carbon atoms, such as methylene, ethylene, iso-butylene or neo-pentylene; and $R^8$ is $R^1$ or $R^2$, most preferably $R^1$.

The basic chromophore of a phthalocyanine dye exhibits the following structure:

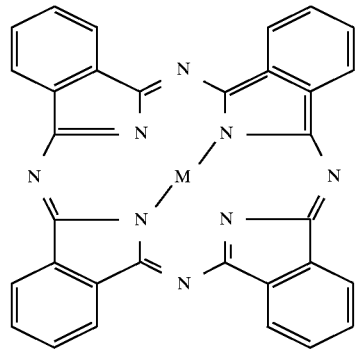

(IX)

where M can be two separate hydrogen atoms or a metal atom, which can be further substituted with halogen, oxy, or organo groups. Preferably M is a divalent metal, such as copper, calcium, cobalt, iron, gallium, magnesium, manganese, nickel, lead, platinum, palladium, tin or zinc. Metals having a valence of three or four can additionally have a halogen, oxy, thioxy or organic substituent, as illustrated by AlCl, AlBr, AMF, AlOH, $AlOR^9$, $AlSR^9$, $Ge(OR^{10})_2$, InCl, $SiCl_2$, SiF2, $Si(OR^{10})_2$, $SnCl_2$, $Sn(OR^{10})_2$, $Si(SR^{10})_2$, TiO and VO. $R^9$ and $R^{10}$ can be hydrogen or organic moieties, such as alkyl, aryl, aralkyl, or alkaryl groups linked directly or are through carbonyl, amido or carbamoyl linking groups, and containing a total of 1 to 20 (preferably 1 to 6) carbon atoms. One of the $R^9$ or $R^{10}$ moieties can take the form $$-M'(R^{11})(R^{13})-R^{12} \quad \text{(X)}$$

where

M' is Sn, Si or Ge, $R^{11}$, $R^{12}$ and $R^{13}$ can be independently selected to take the form of $-O_m-R^{14}$, m is zero or 1, $R^{14}$ is halogen when m is zero or selected from any of the organic moieties named above forming $R^9$ or $R^{10}$. Preferably the organic moieties forming $R^9$, $R^{10}$ and $R^{14}$ are alkyl or alkoxy, phenyl, or alkylphenyl, where the alkyl moieties contain from 1 to 6 carbon atoms.

The phthalocyanine dye chromophore can be substituted, if desired. Substituents can be employed to adjust the hue of the dye chromophore to a specific spectral region. As employed herein the term "phthalocyanine" is employed to encompass, as an optionally substituted form of phthalocyanine, napthocyanine, such as illustrated by the formula:

(XI)

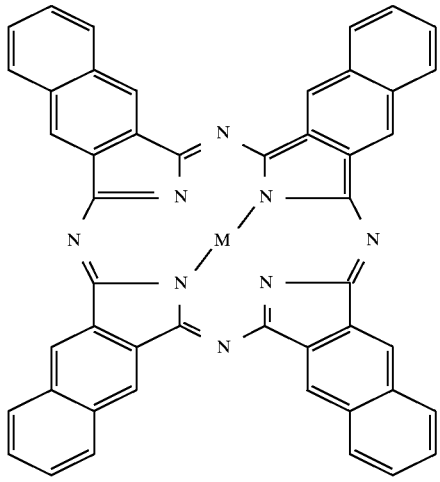

where M is as defined above.

Further, optional substituents of the chromophores of formulae X and XI can displace hydrogen attached to the peripheral carbon atoms and include any of the various forms of $R^{11}$-$R^{13}$, described above, as well as hydroxy and the thio (-S-) analogues of the oxy containing moieties—e.g., -S-$R^{15}$, where $R^{15}$ is hydrogen or any of the various forms of hydrocarbon moieties described in connection with $R^{11}$-$R^{13}$.

Varied forms of phthalocyanine dye chromophore containing monomers for incorporation in the ionic linear condensation polymers are disclosed by Krutak et al U.S. Pat. No. 5,292,855, the disclosure of which is here incorporated by reference.

Based on the entire ionic linear condensation polymer amounting to 100 mole percent, the phthalocyanine dye chromophore containing repeating units can account for from 1 molar part per million (mppm), $1\times10^{-4}$ expressed as mole percent, up to about 10 mole percent. The phthalocyanine dye chromophore containing repeating units preferably account for at least 1 mole percent of the total polymer.

The total amount of phthalocyanine dye present in the element is a function of the amount of magenta dye that remains in the element after processing. It is preferred that the amount of phthalocyanine dye be chosen to shift negatively the a* values of the radiographic element at least 0.2. The coating levels of the phthalocyanine dye are chosen to provide an overall radiographic element red (e.g., 650 nm) density that ranges from a just detectable density increase to less than 0.30, including any contribution to red density provided by blue dye. It is generally preferred to employ phthalocyanine dye in concentrations that provide a red density (including blue dye contributions to red density) that matches the green (e.g., 505 nm) density provided by the magenta dye or dyes remaining after processing. Thus, phthalocyanine dye will be usually be present in a concentration that provides a red (e.g., 650 nm) density of greater than 0.1.

As an alternative or supplement to incorporating a conventional blue dye in the radiographic element, typically in the transparent film support, it is optionally and preferably contemplated to incorporate a blue anthraquinone dye as a repeating unit in an ionic linear condensation polymer. Except for the substitution of an anthraquinone dye chromophore for a phthalocyanine dye chromophore, the blue ionic linear condensation polymer can take any of the forms of the cyan ionic linear condensation polymer described above. Generally convenient physical handling properties are observed in the ionic linear condensation polymer containing the anthraquinone dye when overall molecular weights are maintained in the in the range of from about 10,000 to 100,000.

General descriptions of linear condensation polymers containing anthraquinone dye repeating units are provided by Davis et al U.S. Pat. No. 4,267,306 and Weaver et al U.S. Pat. Nos. 4,804,719, 5,372,864 and 5,384,377 and Krutak et al U.S. Pat. No. 4,999,418, all cited above and here incorporated by reference. The anthraquinone repeating units disclosed in these patents that produce blue polymers are specifically contemplated to be incorporated in the ionic linear condensation polymers employed in the practice of this invention.

A preferred class of anthraquinone monomers useful in forming repeating units in the ionic linear condensation polymers are represented by the formula:

(XII)

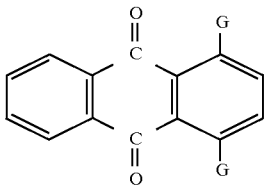

where G is a reactive group $R^1$ or $R^2$, described above, which is preferably linked to the anthraquinone through a linking group. Synthetically convenient ring attachments of G that have preferred half-peak absorption bandwidths are realized when an amino nitrogen atom is bonded to the anthraquinone at its 1 and 4 ring positions. The amino nitrogen atom is then further substituted to provide a synthetically convenient linkage to the reactive group. For example, the amino nitrogen can be provided by an anilino group that is further substituted to provide a reactive group.

A specifically preferred class of anthraquinone dye chromophore containing monomers contemplated for incorporation in the ionic linear condensation polymers are those in which G satisfies the formula:

(XIII)

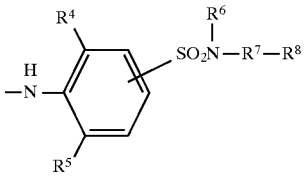

wherein $R^4$ and $R^5$ are independently selected alkyl groups containing from 1 to 6 carbon atoms, preferably methyl or ethyl groups, and $R^6$, $R^7$ and $R^8$ are as described above.

Another specifically preferred class of anthraquinone dye chromophore containing monomers contemplated for incorporation in the ionic linear condensation polymers are those in which G satisfies the formula:

$$—NH—CH_2—C(R^{16})(R^{17})—CH_2—R^{18} \quad (XIV)$$

wherein $R^{16}$ and $R^{17}$ are independently selected alkyl groups containing from 1 to 6 carbon atoms, preferably methyl or ethyl groups; and $R^{18}$ is $R^1$ or $R^2$ or an alkylene group of 1 to 6 carbon atoms or an arylene group of 6 to 10 carbon atoms that contains $R^1$ or $R^2$ as a substituent, preferably a terminal substituent. Linking groups of this type are disclosed by Krutak et al U.S. Pat. No. 4,999,418, cited above and here incorporated by reference.

Based on the entire blue anthraquinone chromophore containing ionic linear condensation polymer amounting to 100 mole percent, the anthraquinone dye chromophore containing repeating units can account for from 1 molar part per million (mppm), $1\times10^{-4}$ expressed as mole percent, up to the about 10 mole percent. The anthraquinone dye chromophore repeating units preferably account for at least 1 mole percent of the total polymer.

It is recognized that the phthalocyanine dye chromophore and the anthraquinone dye chromophore can, if desired, both form repeating units in the same condensation polymer.

The blue dye is incorporated in the radiographic element in an amount sufficient to provide a noticeable blue tint. Quantitatively, the blue dye is present in an amount sufficient to shift the b* value of the radiographic element to a value that is at least 0.7 more negative than it would otherwise be. Preferably the blue dye imparts to the radiographic element a minimum neutral density of at least 0.1. The blue dye can be incorporated in the transparent film support, as is conventional, or the blue anthraquinone dye can form a repeating unit of an ionic linear condensation polymer, as described above, and be incorporated in one or more hydrophilic colloid layers forming the radiographic element.

It is generally preferred that ionic linear condensation polymer containing phthalocyanine dye, anthraquinone dye, or a combination of both dyes account for less than half the weight of the hydrophilic colloid layer or layers in which it is incorporated. The maximum amount of dye from all sources that can be tolerated is that which increases the overall neutral density of the radiographic element to less than 0.3 (preferably less than 0.25) in minimum density areas following exposure and processing. Neutral density is determined from the specular transmission of white light through the radiographic element following imagewise exposure and processing.

Exposure and rapid access processing of the radiographic elements can be undertaken as illustrated in the patents cited and incorporated by reference above in the Radiographic Elements Listing.

EXAMPLES

The invention can be better appreciated by reference to the following specific embodiments. All coating coverages are in $mg/dm^2$, except as otherwise indicated. ppm is used to designate parts per million parts on a weight basis.

Preparation of Ionic Linear Condensation Polymers Cyan Dye PC

A ionic linear condensation polymer containing a cyan phthalocyanine dye chromophore was prepared as follows: Components (a)–(g) comprising (a) 161.0 g (0.97 mole) isophthalic acid (b) 57.1 g (0.23 mole) 5-lithiosulfoisophthalate (c) 108.4 g (1.02 moles) diethylene glycol (d) 82.3 g (0.57 mole) 1,4-cyclohexane dimethanol (e) 1.9 g (0.023 mole) anhydrous sodium acetate (f) 200 ppm Ti catalyst as titanium-tetraisopropoxide and, (g) 28.0 g ($3.1\times10^{-2}$ mole) copper x,y-bis(hydroxy-neopentylsulfamoyl)phthalocyanine (an isomeric mixture, in which x varies between 1, 2, 3 and 4, but is predominantly 2 and 3 and y varies between 15, 16, 17 and 18, but is predominantly 16 and 17), were added to a 1 L round bottom flask that was fitted with a stirrer, condensate take off, and nitrogen inlet head. The flask and contents were immersed into a salt bath and heated for two hours with stirring at about 200°–250° C., while esterification occurred. To carry out the polycondensation the temperature was increased to 250° C. and the flask was held under vacuum of ≦10 mm Hg for about 1 hour. The resulting polymer was cyan with a weight average equivalent molecular weight of 20000 and $T_g$=~52° C. This polymer contained about 8% by weight, based on total weight, dye chromophore, and was readily soluble in hot water, producing a cyan aqueous solution;

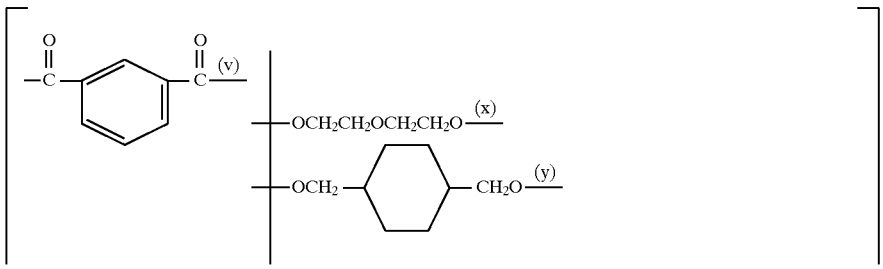

-continued

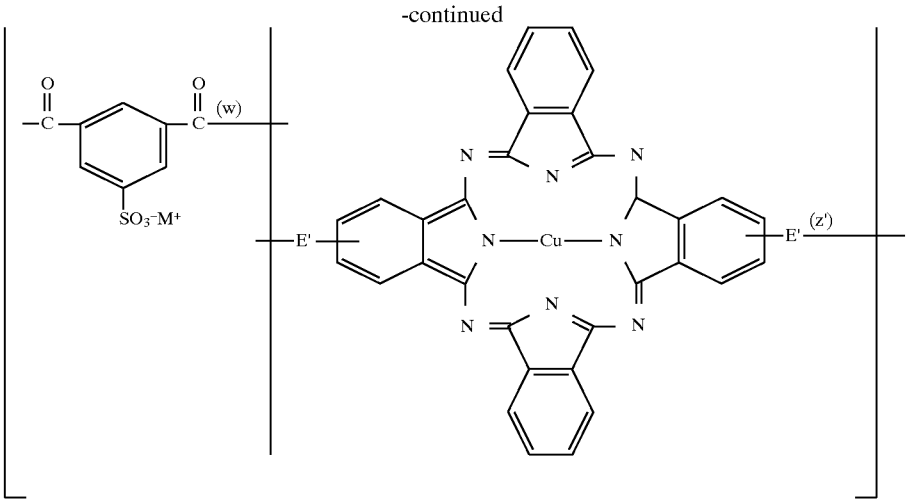

wherein

E'=—$SO_2NHCH_2C(CH_3)_2CH_2O$— v=40.5 mole percent;

w=9.5 mole percent;

x=26.25 mole percent;

y=22.5 mole percent; and z'=1.25 mole percent.

Blue Dye AQ

A ionic linear condensation polymer containing a blue anthraquinone dye chromophore was prepared as follows: Components (a)–(g) comprising (a) 157.5 g (0.95 mole) isophthalic acid (b) 55.8 g (0.22 mole) 5-lithiosulfoisophthalate (c) 106 g (1.0 mole) diethylene glycol (d) 80.5 g (0.56 mole) 1,4-cyclohexane dimethanol (e) 1.9 g (0.023 mole) anhydrous sodium acetate (f) 200 ppm Ti catalyst as titanium-tetraisopropoxide and, (g) 35.0 g ($4.84\times10^{-2}$mole) blue chromophore monomer, 1,4-bis[2-ethyl-x-(2-hydroxyethylsulfamoyl)-6-methylanilino]anthraquinone (an isomeric mixture in which x=3, 4 or 5), were added to a 1 L round bottom flask that was fitted with a stirrer, condensate take off, and nitrogen inlet head. The flask and contents were immersed into a salt bath and heated for two hours with stirring at about 230°–250° C., while esterification occurred. To carry out the polycondensation the temperature was increased to 250° C. and the flask was held under vacuum of ≦10 mm Hg for about 1 hour. The resulting polymer was dark blue with a weight average equivalent molecular weight of 21000 and $T_g$=~53° C. This polymer contained about 10% by weight, based on total weight, dye chromophore, and was readily soluble in hot water, producing a dark blue aqueous solution;

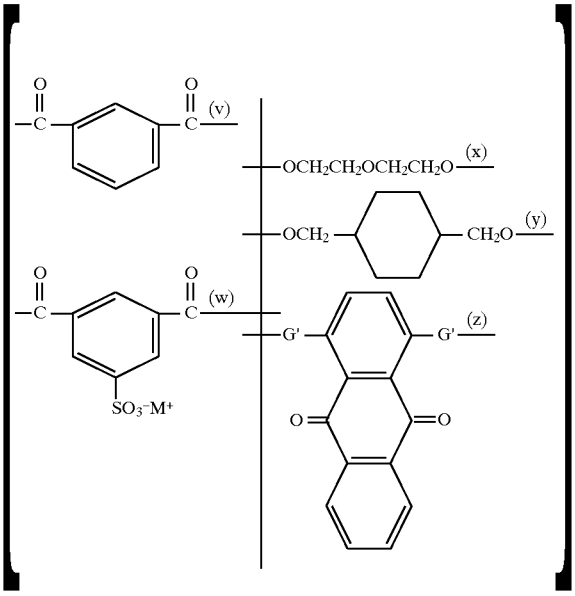

wherein

G' =

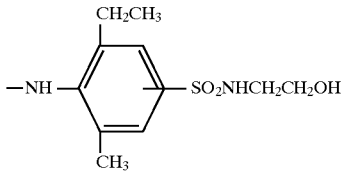

v=40.5 mole percent;

w=9.5 mole percent;

x=26.0 mole percent;

y=22.0 mole percent; and z=2.0 mole percent.

ILCP Dye AQ/PC

A ionic linear condensation polymer containing both an anthraquinone dye chromophore and a phthalocyanine dye chromophore was prepared as follows: Components (a)–(h) comprising (a) 45.0 g (0.27 mole) isophthaihc acid (b) 15.94 g (0.27 mole) 5-lithiosulfoisophthalate (c) 30.28 g (0.29 mole) diethylene glycol (d) 23.0 g (0.16 mole) 1,4-cyclohexane dimethanol (e) 0.54 g ($6.7\times10^{-3}$ mole) anhydrous sodium acetate (f) 200 ppm Ti catalyst as titanium-tetraisopropoxide, (g) 9.57 g ($1.32\times10^{-2}$ mole) blue chromophore monomer, 1,4-bis[2-ethyl-x-(2-hydroxyethylsulfamoyl)-6-methylanilino]anthraquinone (an isomeric mixture in which x=3, 4 or 5), and (h) 28.0 g ($3.1\times10^{-2}$ mole) copper x,y-bis(hydroxy-neopentylsulfamoyl)phthalocyanine (an isomeric mixture, in which x varies between 1, 2, 3 and 4, but is predominantly 2 and 3 and y varies between 15, 16, 17 and 18, but is predominantly 16 and 17), were added to a 500 mL round bottom flask that was fitted with a stirrer, condensate take off, and nitrogen inlet head. The flask and contents were immersed into a salt bath and heated for two hours with stirring at about 230°–250° C., while esterification occurred. To carry out the polycondensation the temperature was increased to 250° C. and the flask was held under vacuum of ≦10 mm Hg for about 2 hour and <1 mm Hgfor an additional 20 minutes. The resulting polymer was dark blue with a weight average equivalent molecular weight of 22000 and $T_g$=~54° C. This polymer contained about 9.6% by weight, based on total weight, anthraquinone dye chromophore and 0.4% by weight, based on total weight, copper phthalocyanine dye chromophore. The polymer was readily soluble in hot water, producing a dark blue aqueous solution;

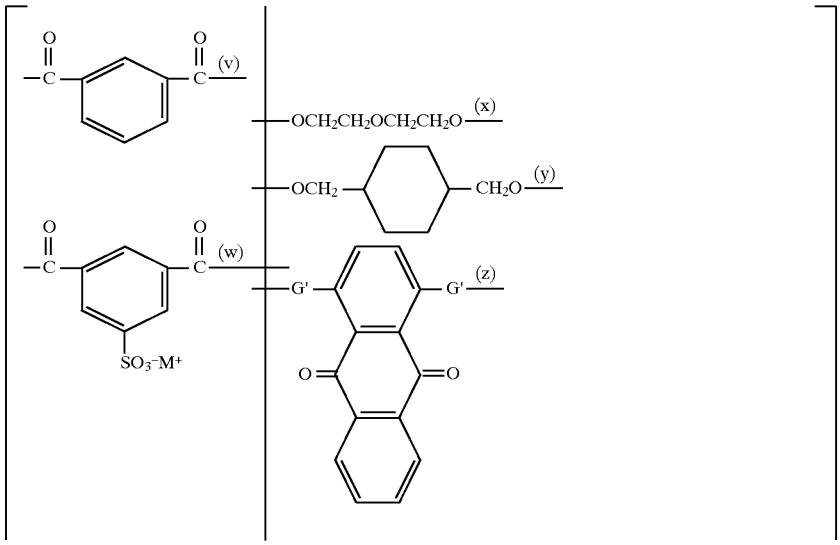

-continued

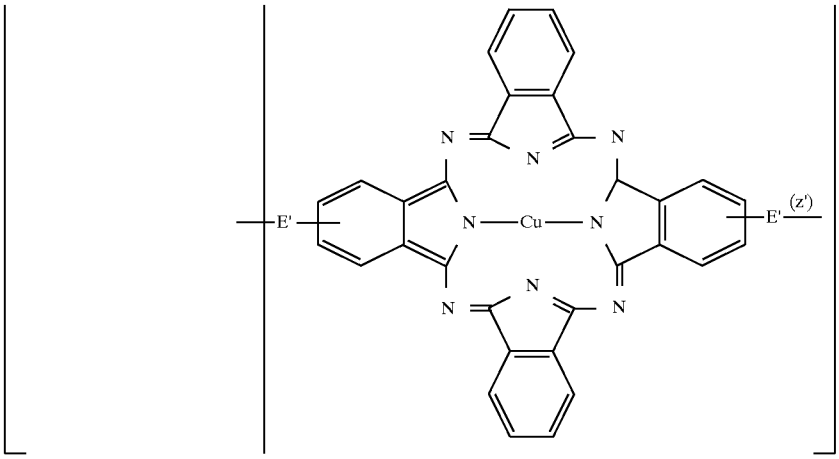

where

G' =

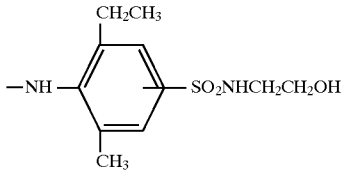

v=40.5 mole percent;

w=9.5 mole percent;

x=26.0 mole percent;

y=22.0 mole percent;

z=1.914 mole percent; and z'=0.086 mole percent.

Element A

A radiographic element was constructed by coating onto both major faces of a blue tinted 7 mil (178 μm) poly (ethylene terephthalate) film support (S) an emulsion layer (EL), an interlayer (IL) and a transparent surface overcoat (SOC), as indicated:

| |
|---|
| SOC |
| IL |
| UEL |
| LEL |
| S |
| LEL |
| UEL |
| IL |
| SOC |

| Contents | Coverage |
|---|---|
| **Upper Emulsion Layer (UEL)** | |
| Ag | 13.0 |
| Gelatin | 13.0 |
| 4-Hydroxy-6-methyl-1,3,3a,7-tetraazaindene | 2.1 g/Ag mole |
| Potassium nitrate | 1.8 |
| Ammonium hexachloropalladate | 0.001 |
| Maleic acid hydrazide | 0.0044 |
| Sorbitol | 0.24 |

-continued

| | |
|---|---|
| Glycerin | 0.26 |
| Potassium Bromide | 0.06 |
| Resorcinol | 0.2 |
| **Lower Emulsion Layer (LEL)** | |
| Ag | 13.1 |
| Gelatin | 13.1 |
| Microcrystalline magenta dye | 0.55 |
| 4-Hydroxy-6-methyl-1,3,3a,7-tetraazaindene | 2.1 g/Ag mole |
| Potassium nitrate | 1.1 |
| Ammonium hexachloropalladate | 0.0013 |
| Maleic acid hydrazide | 0.0053 |
| Sorbitol | 0.32 |
| Glycerin | 0.35 |
| Potassium Bromide | 0.083 |
| Resorcinol | 0.26 |
| Bis(vinylsulfonyl)ether (based on wt. of gelatin) | 2.5% |
| **Interlayer (IL)** | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| **Surface Overcoat (SOC)** | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The Ag in UEL and LEL was provided in the form a thin, high aspect ratio tabular grain silver bromide emulsion in which the tabular grains accounted for greater than 90 percent of total grain projected area, exhibited an average equivalent circular diameter (ECD) of 1.8 μm, an average thickness of 0.13, and an average aspect ratio of 13.8. The tabular grains were optimally spectrally sensitized with a carbocyanine green absorbing spectral sensitizing dye (i.e., a magenta dye). The AgI Lippmann emulsion present in IL exhibited a mean ECD of 0.08 μm.

The microcrystalline magenta dye (Dye MFD) was 1-(4'-carboxyphenyl)-4-(4'-dimethylaminobenzylidene)-3-ethoxycarbonyl-2-pyrazolin-5-one.

Element B

This element was identical to Element A, except that the coating coverage of the microcrystalline magenta dye was increased from 0.55 to 1.1.

Element C

This element was identical to Element A, except that the coating coverage of the microcrystalline magenta dye was increased from 0.55 to 2.2.

Element D

This element was identical to Element B, except that cyan dye PC was added to the lower emulsion layer on each side of the support in the coating coverage of 0.55.

Element E

This element was identical to Element D, except that cyan dye PC was added to the lower emulsion layer on each side of the support in the coating coverage of 1.1.

Element F

This element was identical to Element D, except that cyan dye PC was added to the lower emulsion layer on each side of the support in the coating coverage of 2.2.

Exposure and Processing

To simulate exposure by a pair of green emitting intensifying screens, samples of each of the elements were simultaneously exposed on each side for 1/50 sec through a graduated density step tablet using a MacBeth™ sensitometer having a 500 watt General Electric DMX™ projector lamp calibrated to 2650° K and filtered through a Corning C4010™ filter (480–600 nm, 530 nm peak transmission).

The exposed elements were processed using a Kodak X-Omat RA 480™ rapid access processor set for the following processing cycle:

| | |
|---|---|
| Development | 8.3 seconds at 40° C. |
| Fixing | 7.0 seconds at 30° C. |
| Washing | 5.6 seconds at room temperature |
| Drying | 9.1 seconds at 67.5° C. |

The following developer was employed, components are expressed in g/L, except as indicated:

| | |
|---|---|
| Hydroquinone | 32 |
| 4-Hydroxymethyl-4-methyl-1-phenyl-3-pyrazolidinone | 6 |
| Potassium bromide | 2.25 |
| 5-Methylbenzotriazole | 0.125 |
| Sodium sulfite | 160 |
| Water to 1 liter | |
| pH | 10 |

All of the elements emerged dry from the processor. Evaluation of speed, contrast, maximum density and percent crossover as described in Dickerson U.S. Pat. No. 5,576,156 indicated acceptable imaging performance. Minimum neutral densities were near maximum acceptable levels.

Red Light Transmission

To evaluate the effectiveness of the cyan phthalocyanine dye to reduce red light transmission, the a* values of samples of processed Elements A–F were undertaken. a* values were determined by CIELAB standards for spectra recorded from 400 to 700 nm using 5500° K light as an illuminant. The results are summarized below in Table I.

TABLE I

| Element | Dye MFD | Dye PC | a* |
|---|---|---|---|
| A | 0.55 | 0 | 1.07 |
| B | 1.1 | 0 | 1.42 |
| C | 2.2 | 0 | 1.90 |
| D | 1.1 | 0.55 | 0.016 |
| E | 1.1 | 1.1 | −0.45 |
| F | 1.1 | 2.2 | −2.0 |

From Table I it is apparent that increasing coating coverages of the magenta filter dye result in progressively higher levels of a* values in the absence of cyan phthalocyanine dye. This indicates that the dye is at least partially remaining in the elements following the rapid access processing. The positive a* values are indicative of red light transmission through the elements.

When the cyan phthalocyanine dye is incorporated in the form of repeating units in a linear ionic condensation polymer, a* values decline dramatically from positive to negative values. This indicates that the cyan phthalocyanine dye is intercepting red light that would otherwise be transmitted through the element. Thus the ionic cyan phthalocyanine containing linear condensation polymer offers a convenient approach for lowering red light transmission through green sensitized radiographic elements that exhibit elevated green densities as a result of incomplete removal of magenta dye in rapid access processing. The cyan phthalocyanine dye is capable of reducing red transmission to a greater degree than blue dye at the same overall neutral density.

The invention has been described in detail with particular reference to preferred embodiments thereof, but it will be understood that variations and modifications can be effected within the spirit and scope of the invention.

What is claimed is:

1. A radiographic element capable of producing a maximum density of at least 3.0 when imagewise exposed by X-radiation stimulated intensifying screen emission of green light and processed in less than 45 seconds, said element being comprised of a transparent film support having first and second major faces, a fully forehardened hydrophilic colloid layer unit coated on each major face of the support, at least one of the layer units including radiation-sensitive silver halide grains, one or a combination of magenta dyes, including a dye for spectrally sensitizing the radiation-sensitive silver halide grains to green light, said dyes leaving a residual density at 505 nm of greater than 0.1 when the element is processed in less than 45 seconds, and a blue dye that increases neutral density in minimum density areas after imagewise exposure and processing, WHEREIN, transmission of red light through the radiographic element when imagewise exposed and processed in less than 45 seconds to produce a viewable image is reduced by the incorporation in at least one of the hydrophilic colloid layers of at least one ionic linear condensation polymer containing a cyan phthalocyanine dye.

2. A radiographic element according to claim 1 wherein only one of the hydrophilic colloid layer units contains radiation-sensitive silver halide grains and the hydrophilic colloid layer unit remaining contains at least one of the magenta dyes in the form of an antihalation dye.

3. A radiographic element according to claim 1 wherein at least one of the magenta dyes is a microcrystalline dye.

4. A radiographic element according to claim 3 wherein the microcrystalline magenta dye is 1-(4'-carboxyphenyl)-4-(4'-dimethylaminobenzylidene)-3-ethoxycarbonyl-2-pyrazolin-5-one.

5. A radiographic element according to claim 3 wherein each of the hydrophilic colloid layer units contains two or more hydrophilic colloid layers, at least one the hydrophilic colloid layers containing the radiation-sensitive silver grains and the microcrystalline magenta dye being present in each of the hydrophilic colloid layer units in a hydrophilic colloid layer coated nearer the support than at least one other hydrophilic colloid layer containing the radiation-sensitive silver halide grains.

6. A radiographic element according to claim 5 wherein the hydrophilic colloid layer in each of the layer units containing the magenta dye in microcrystalline form also contains a portion of the radiation-sensitive silver halide grains.

7. A radiographic element according to claim 1 wherein the radiographic element exhibits a minimum density of less than 0.30 when imagewise exposed and processed in less than 45 seconds.

8. A radiographic element according to claim 7 wherein the blue dye is present in an amount sufficient to shift image tone measured after imagewise exposure and processing in less than 45 seconds in terms of a CIELAB b* value negative shift of at least 0.7.

9. A radiographic element according to claim 7 wherein the phthalocyanine dye is present in an amount sufficient to shift the image measured after imagewise exposure and processing in less than 45 seconds in terms of a CIELAB a* value negative shift of at least 0.2.

10. A radiographic element according to claim 1 wherein the ionic linear condensation polymer containing cyan phthalocyanine dye is a polyester.

11. A radiographic element according to claim 10 wherein the ionic linear condensation polymer contains ionic repeating units.

12. A radiographic element according to claim 11 wherein the ionic repeating units are derived from a sulfo-substituted dicarboxylic acid.

13. A radiographic element according to claim 12 wherein repeating units of the cyan phthalocyanine dye exhibits the formula:

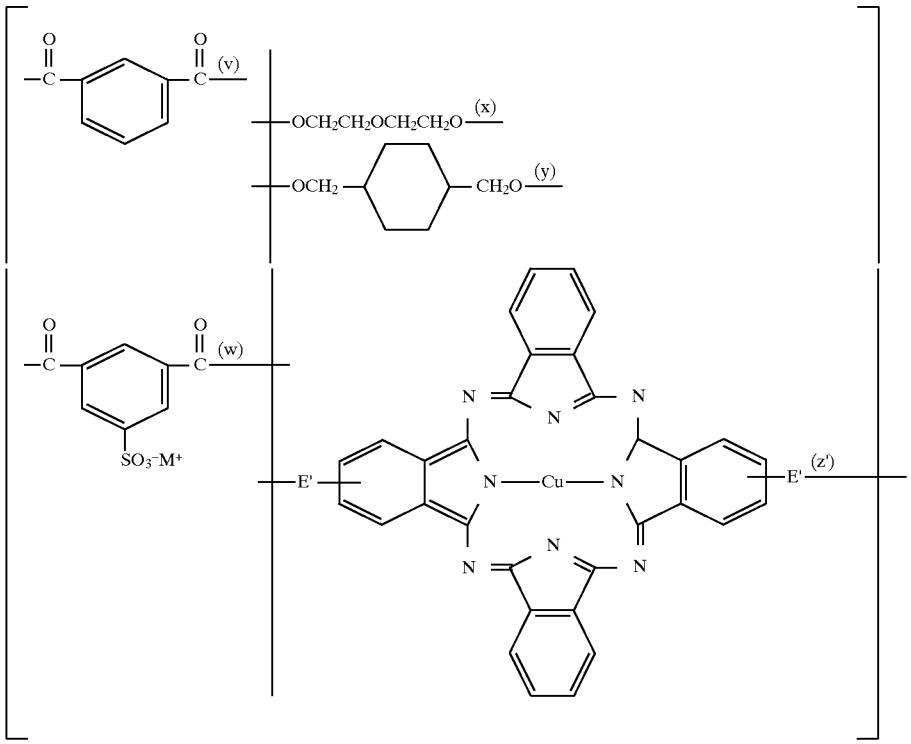

wherein

E'=—$SO_2NHCH_2C(CH_3)_2CH_2O$— v=50 mole percent less w;

w=$10^{-4}$ to 40 mole percent;

x+y=50 mole percent less z'; and z'=$10^{-4}$ to 10 mole percent;

$m^+$=a counter ion and the repeating units are chosen to provide an overall molecular weight in the range of from 10,000 to 100,000.

* * * * *